US005487686A

United States Patent [19]

Sawada

[11] Patent Number: 5,487,686

[45] Date of Patent: Jan. 30, 1996

[54] PIN TERMINAL

[75] Inventor: Yoshitsugu Sawada, Shizuoka, Japan

[73] Assignee: Yazaki Corporation, Tokyo, Japan

[21] Appl. No.: 257,829

[22] Filed: Jun. 9, 1994

[30] Foreign Application Priority Data

Jun. 10, 1993 [JP] Japan ..... 5-163815

[51] Int. Cl.[6] ..... H01R 4/02

[52] U.S. Cl. ..... 439/884; 439/692; 439/877

[58] Field of Search ..... 439/433, 434, 439/877, 879, 882, 692, 884

[56] References Cited

U.S. PATENT DOCUMENTS 3,418,623 12/1968 Ruehlemann ..... 439/879
4,923,416 5/1990 Zinn ..... 439/877

FOREIGN PATENT DOCUMENTS 2500963 9/1982 France ..... 439/879
0309570 12/1990 Japan ..... 439/877

*Primary Examiner*—David L. Pirlot
*Assistant Examiner*—Barry Matthew L. Standig
*Attorney, Agent, or Firm*—Sughrue, Mion, Zinn, Macpeak & Seas

[57] ABSTRACT

A pin terminal includes a rounded pin-like electrical connection portion, a body portion, an interconnecting portion, a conductor clamping portion and a covering clamping portion, and this pin terminal is processed into a roll-shape. A drawn portion of a corrugated configuration is circumferentially provided by pressing between the cylindrical body portion of a larger diameter and each of the electrical connection portion of a smaller diameter and the interconnecting portion of a smaller diameter.

3 Claims, 3 Drawing Sheets

FIG. 1(b)
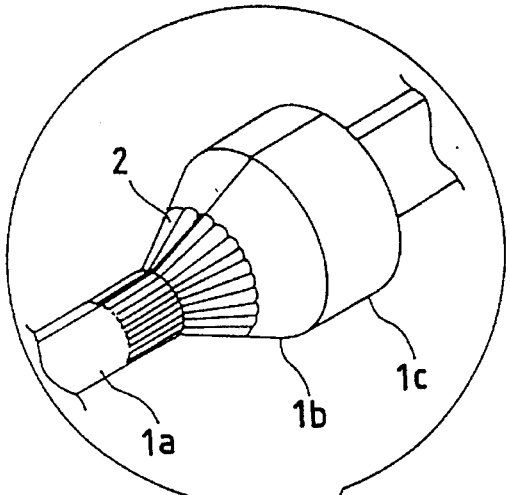
FIG. 1(c)
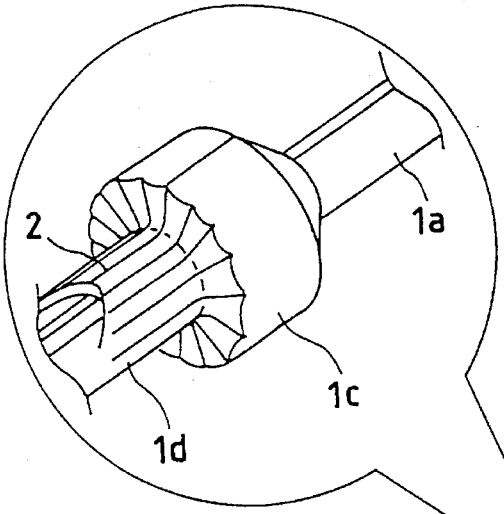
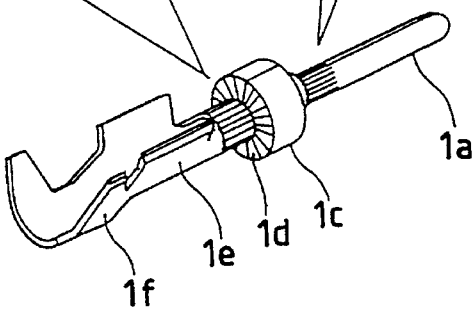
FIG. 1(a)

PIN TERMINAL

BACKGROUND OF THE INVENTION

1. Field of the Invention

This invention relates to a pin terminal which is enhanced in strength to meet a small-size design.

2. Related Art

One example of a pin terminal to be connected to a connector is disclosed in Japanese Utility Model Unexamined Publication No. 53-137685. As shown in FIG. 5, a wire 106 is connected to this pin terminal 101 by compressively deforming a conductor clamping portion 101*e* and a covering clamping portion 101*f*, and a body portion 101*c* of this terminal is fitted in a connector housing to position the terminal at a proper location, so that a pin plug-like electrical connection portion 101*a* for electrical connection to a female terminal of a mating connector (not shown) is projected toward the front side of the connector.

The pin terminal of this type is usually formed by stamping a sheet of electrically-conductive metal such as phosphor bronze and then by processing it into a roll-shape.

By the way, recently, connectors have been increasingly required to have a small-size design, and also the pin terminal under consideration has also been required to have a small-size design for use with a very small current.

SUMMARY OF THE INVENTION

It is an object of this invention to provide a pin terminal which is enhanced in strength and also in shaping ability when the pin terminal is formed into a small-size design in accordance with a small-size design of a connector.

The above object of the present invention has been achieved by a pin terminal characterized in that a shaped piece, which is stamped from a metal sheet, and has at least an electrical connection portion, a body portion, an interconnecting portion and a wire connection portion in this sequence, is processed into a roll-shape; the body portion has a cylindrical shape larger in diameter than the electrical connection portion and the interconnecting portion; and the shaped piece has a drawn portion of a corrugated configuration circumferentially provided between the body portion and each of the electrical connection portion and the interconnecting portion.

In the shaped piece, the drawn portion of a corrugated configuration is provided between the electrical connection portion and the body portion before the shaped piece is formed into a roll-shape, and therefore the drawn portion has the effect of beams to enhance the strength, so that damage to the electrical connection portion can be prevented.

The drawn portion is also provided between the body portion and the interconnecting portion extending continuously from this body portion, and this drawn portion cooperates with the drawn portion, provided between the body portion and the electrical connection portion, to enhance the shaping ability.

BRIEF DESCRIPTION OF THE DRAWINGS

FIGS. 1(*a*) to (*c*) are perspective views showing the appearance of a second embodiment of the present invention, as well as enlarged perspective views of important portions thereof;

DETAILED DESCRIPTION OF THE PREFERRED EMBODIMENTS

A preferred embodiment of the present invention will now be described with reference to the drawings.

Figure 6:
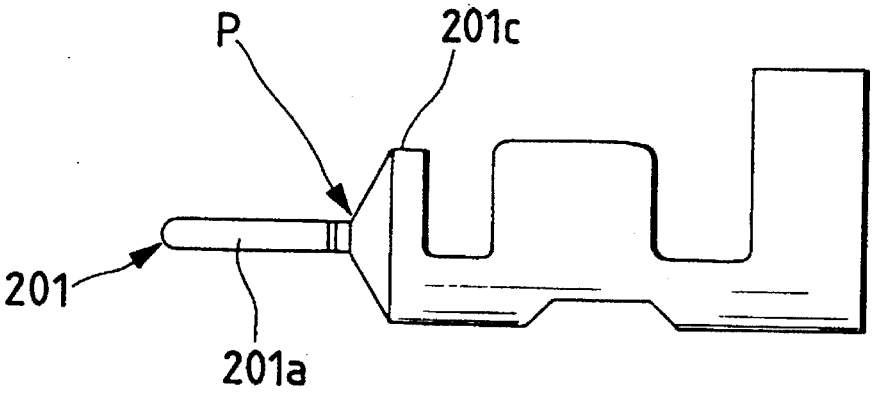
FIG. 6 is a a perspective view showing a first embodiment of the present invention.

FIG. 6 shows a pin plug of a first embodiment of the present invention. A pin plug-like electrical connection portion 201*a* is formed into a small diameter before connecting a wire, and also in order to prevent a holding force of a housing from being reduced in accordance with the small-size design of the connector, the angle of inclination of a body portion 201*c* is made acute.

With this construction, however, there has been encountered a problem that stresses concentrate on a proximal end portion P of the electrical connection portion 201*a* of the pin terminal 201, so that the electrical connection portion is liable to be broken.

In view of the circumstance, a second embodiment of the present invention will now be described hereinafter.

Figure 2:
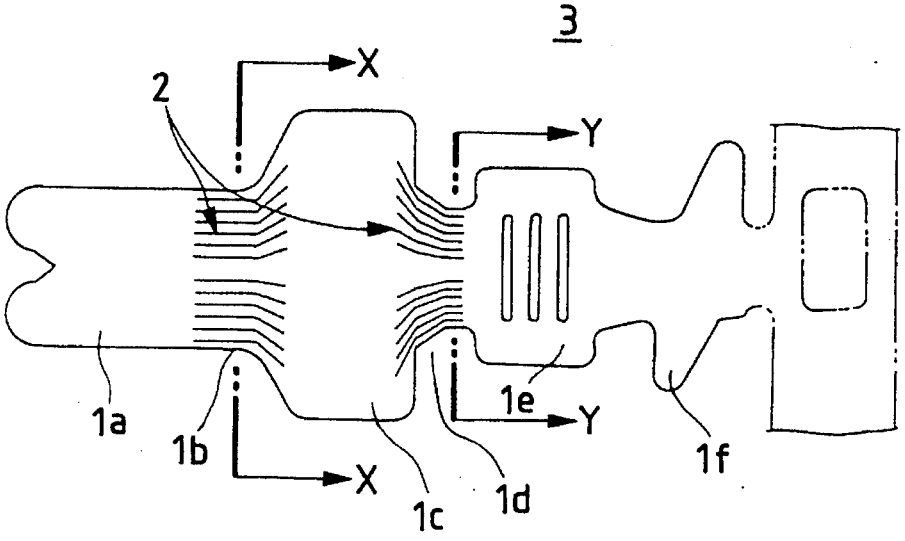
FIG. 2 is a developed view of a pin terminal of FIG. 1.
Figure 3:
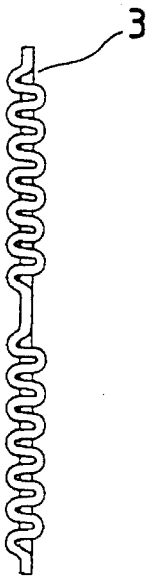
FIG. 3 is a cross-sectional view of drawn portions taken along the line X—X and the line Y—Y of FIG. 2.
Figure 4:
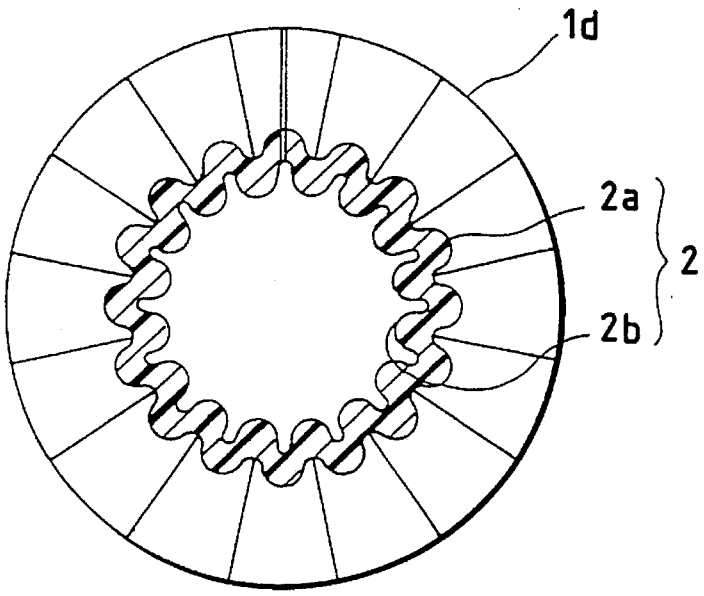
FIG. 4 is a cross-sectional view showing an important portion of the pin terminal.
Figure 5:
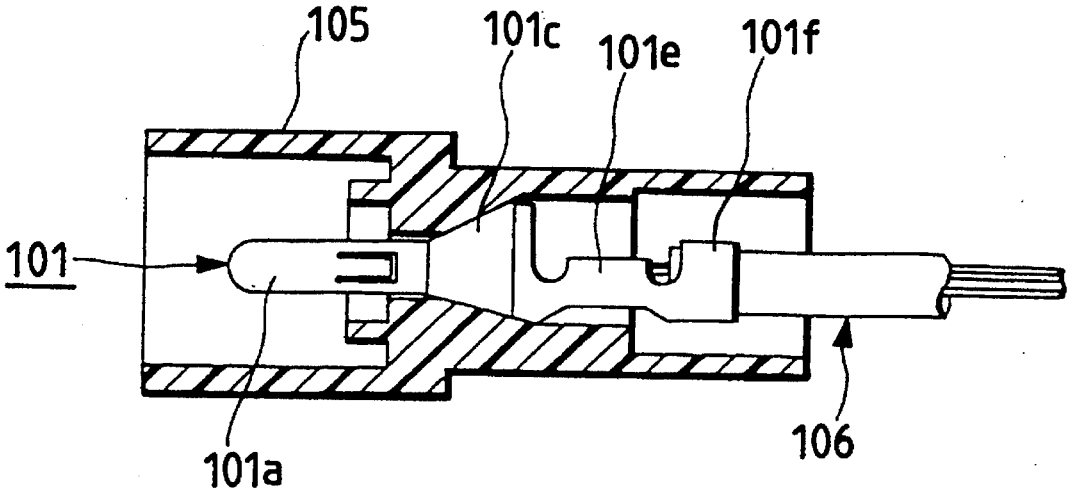
FIG. 5 PRIOR ART
FIG. 5 is a cross-sectional view of a conventional terminal attached to a connector.

FIGS. 1(*a*) to (*c*) perspective views showing the appearance of the second embodiment of a pin terminal of the present invention, as well as enlarged perspective views of important portions thereof. FIG. 2 is a developed view of the pin terminal of FIG. 1, FIG. 3 is a cross-sectional view taken along the line X—X and the line Y—Y of FIG. 2, and FIG. 4 is a cross-sectional view showing an important portion of the pin terminal.

This pin terminal 1 includes an electrical connection portion 1*a* of a smaller diameter having a rounded, conical, tapered distal end, a body portion 1*c* of a cylindrical shape which has a tapered surface 1*b* progressively increasing in diameter from the electrical connection portion 1*a*, and a cylindrical interconnecting portion 1*d* of a smaller diameter extending from a rear end of the body portion 1*c* to a conductor clamping portion 1*e* and a covering clamping portion 1*f* which cooperate with each other to form a wire connection portion.

At a region corresponding to the proximal end portion of the electrical connection portion 1*a*, there is provided a drawn portion 2 which is circumferentially drawn into a corrugated configuration, this drawn portion 2 covering part of the tapered surface 1*b*. A similar drawn portion 2 is also provided at that region covering a rear end of the body portion 1*c* and the interconnecting portion 1*d*.

For forming the pin terminal 1, a metal sheet of phosphor bronze is stamped into a predetermined shape, and a plurality of shaped pieces 3 connected together are separated from one another as shown in FIG. 2, and each shaped piece 3 is processed into a roll-shape. Since the body portion 1*c* of a larger diameter, and the electrical connection portion 1*a* of a smaller diameter and the interconnecting portion 1*d* of a smaller diameter, which extend continuously from the body portion 1*c*, are abruptly drawn, the drawn portions 2, having a corrugated shape as shown in FIG. 3, are formed at these portions by pressing.

As a result of providing the drawn portions 2, in the pin terminal 1 formed into a roll-shape, the distance between adjacent ridges at an outer corrugated surface 2*a* of the interconnecting portion 1*d* is larger, and the radius of curvature of the curved portions of this outer surface is larger, whereas the distance between adjacent ridges at an inner corrugated surface 2*b* is smaller, and the radius of curvature of the curved portions of this inner surface is smaller, as seen from the cross-sectional view of FIG. 4 in which the body portion 1*c* is viewed from its rear end toward the front end of the pin.

With this configuration of the outer corrugated surface 2*a* and the inner corrugated surface 2*b*, strains of the metal material itself caused by the abrupt drawing can be absorbed, and a crack and tear at the drawn portion can be prevented.

Therefore, the pin terminal, shaped to meet a small-size design of a connector, can be satisfactorily formed into a small-size design.

More specifically, the curved portions at the outer corrugated surface 2*a* achieve the effect of beams to enhance the strength of the drawn portion, and the curved portions at the inner corrugated surface 2*b* achieve an enhanced shaping ability of the drawn portion because of a compressed construction thereof.

The thus shaped pin terminal is connected to the connector (not shown) which is formed into a small-size design according to a conventional procedure. At this time, the tapered surface 1*b* of the body portion 1*c* is engaged in a receiving portion formed on a connector housing (not shown), so that the terminal is held at a proper position. The body portion 1*c* is formed into a cylindrical shape of a larger diameter, and the conductor clamping portion 1*e* extending from the interconnecting portion 1*d* has a smaller diameter. The reason for this is to eliminate the possibility that burrs, produced on the conductor clamping portion when this conductor clamping portion is compressively deformed, are obstructive as in the prior art when the terminal is to be inserted into the housing.

As described above, in the pin terminal of the present invention, the corrugated drawing is provided at the abruptly drawn portions, and therefore the strength and the shaping ability can be enhanced, and particularly when the small-size design is used, the strength capable of providing a sufficient withstanding force can be achieved.

What is claimed is:

1. A pin terminal comprising:

an electrical connection portion;

a body portion continuously provided with the electrical connection portion;

an interconnecting portion continuously provided with the body portion;

a wire connection portion continuously provided with the interconnecting portion; and corrugated configuration portions circumferentially provided at least one of between the body portion and the electrical connection portion and between the body portion and the interconnecting portion, respectively, wherein the body portion has a cylindrical shape larger in diameter than the electrical connection portion and the interconnecting portion.

2. A pin terminal as claimed in claim 1, wherein a tapered surface is formed on the body portion continuously extending from the electrical connection portion, and is increasing in diameter progressively away from the electrical connection portion.

3. A pin terminal as claimed in claim 1, wherein the corrugated configuration portion is formed by drawing process.

* * * * *